US008676080B2

(12) United States Patent
Inoue

(10) Patent No.: US 8,676,080 B2
(45) Date of Patent: Mar. 18, 2014

(54) IMAGE FORMING APPARATUS WHICH FORMS IMAGES ON ONE SIDE OR BOTH SIDES OF A SHEET

(71) Applicant: Canon Kabushiki Kaisha, Tokyo (JP)

(72) Inventor: Kozo Inoue, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/750,717

(22) Filed: Jan. 25, 2013

(65) Prior Publication Data

US 2013/0136482 A1 May 30, 2013

Related U.S. Application Data

(63) Continuation of application No. 12/831,060, filed on Jul. 6, 2010, now Pat. No. 8,385,765.

(30) Foreign Application Priority Data

Jul. 10, 2009 (JP) ..... 2009-163761

(51) Int. Cl.
*G03G 15/00* (2006.01)

(52) U.S. Cl.
USPC ..... 399/82; 271/207; 399/16; 399/405

(58) Field of Classification Search
USPC ..... 399/82, 16, 38, 404, 405; 271/278, 207
See application file for complete search history.

(56) References Cited

U.S. PATENT DOCUMENTS

| | | | | |
|---|---|---|---|---|
| 8,385,765 | B2 * | 2/2013 | Inoue | 399/82 |
| 2006/0120738 | A1 * | 6/2006 | Bartley et al. | 399/45 |

* cited by examiner

*Primary Examiner* — Sophia S Chen
(74) *Attorney, Agent, or Firm* — Canon USA Inc. IP Division

(57) ABSTRACT

An image forming apparatus capable of selectively discharging a sheet having an image formed with toner on one surface thereof and a sheet having images formed with toner on both surfaces thereof includes a fixing unit configured to fix a toner image on a sheet, a sheet stacking portion configured to stack sheets each having the toner image fixed thereon, and a control portion configured to control a maximum sheet stacking amount of sheets stacked in the sheet stacking portion. The control portion controls the maximum sheet stacking amount set when sheets, at least one of which has the toner images formed on both surfaces thereof, are stacked to be smaller than the maximum sheet stacking amount set when sheets each having the toner image formed on one surface thereof are stacked.

5 Claims, 5 Drawing Sheets

IMAGE FORMING APPARATUS WHICH FORMS IMAGES ON ONE SIDE OR BOTH SIDES OF A SHEET

This application is a continuation application of U.S. application Ser. No. 12/831,060 filed Jul. 6, 2010, which claims priority from Japanese Patent Application No. 2009-163761 filed Jul. 10, 2009, which are hereby incorporated by reference herein in their entirety.

BACKGROUND OF THE INVENTION

1. Field of the Invention

The present invention relates to an image forming apparatus, and in particular, it relates to a configuration for prevention of blocking of sheets that have been discharged onto a discharge tray without causing a reduction in image quality or productivity.

2. Description of the Related Art

Conventionally, an image forming apparatus, such as a printer, a copying machine, or the like, which executes image formation by using an electrophotographic system, transfers a toner image to a sheet, conveys the sheet to a fixing device, and fixes the toner image to thereby form an image on the sheet. Furthermore this type of imaging forming apparatus includes a two-sided (double-sided) image forming mode in which a reversing unit reverses the sheet with the image formed thereon and then a re-conveyance unit conveys the sheet again to an image forming portion to thereby execute image formation on both the front and back surfaces of the sheet.

However, in this type of conventional image forming apparatus, after fixing of the toner image, although the sheet is discharged onto a discharge tray, the sheet may not yet be sufficiently cooled. Consequently, melted toner on a sheet which is discharged onto the discharge tray may cause a blocking phenomenon with a sheet that has already been discharged onto the discharge tray. In particular, when an image is formed on both surfaces of a sheet (recording medium), toner on adjacent sheets in the discharge tray comes into direct contact and generally increases the occurrence of a blocking phenomenon. U.S. Patent Application Publication No. 2007/0196152 discusses an approach for this type of sheet blocking, for example, by providing a cooling portion that brings a sheet into contact with cooling air along the direction of sheet stacking to thereby reduce the temperature of the sheets which are discharged onto the discharge tray. Japanese Patent Application Laid-Open No. 2008-242335 discusses an apparatus which includes a temperature detection portion that detects a temperature of a sheet discharged onto the discharge tray and executes control to vary the sheet-to-sheet distance or the fixing temperature based on the temperature result detected by the temperature detection portion. In an image forming apparatus that executes this type of control, when the temperature of a sheet discharged onto the discharge tray is a temperature that will cause a blocking phenomenon, the temperature of the sheet discharged onto the discharge tray can be reduced by increasing the sheet-to-sheet distance or by reducing the fixing temperature.

However the sharp growth of color applications in recent years has created a need in the print-on-demand (POD) market, the graphics art (GA) market or the like for extremely high image quality in the images formed on sheets. Furthermore, there has been a corresponding increase in the demand for high-speed production of high-quality image sheets. When an extremely high-quality image is formed on the sheet, the amount of toner used in the image formed on the sheet is higher than the amount used in a conventional image. However, when a toner amount increases in a conventional image forming apparatus, the weight per sheet increases and a blocking phenomenon caused by blocking of adjacent sheets in a lower portion may occur due to the weight of sheets stacked in the discharge tray. When a high-quality image is formed on both sides of a sheet, since the toner on the sheets stacked in the discharge tray comes into direct contact, there is a higher possibility of a blocking phenomenon occurring. When executing high-speed production of high-quality images, if blocking of sheets is prevented, for example, by increasing the sheet-to-sheet distance, productivity will be adversely affected, and if the fixing temperature is reduced, image quality will be adversely affected.

SUMMARY OF THE INVENTION

The present invention is directed to an image forming apparatus that prevents blocking of sheets without adversely affecting productivity or image quality.

According to an aspect of the present invention, an image forming apparatus capable of selectively discharging a sheet having an image formed with toner on one surface thereof and a sheet having images formed with toner on both surfaces thereof includes a fixing unit configured to fix a toner image on a sheet, a sheet stacking portion configured to stack sheets each having the toner image fixed thereon, and a control portion configured to control a maximum sheet stacking amount of sheets stacked in the sheet stacking portion. The control portion controls the maximum sheet stacking amount set when sheets, at least one of which has the toner images formed on both surfaces thereof, are stacked to be smaller than the maximum sheet stacking amount set when sheets each having the toner image formed on one surface thereof are stacked.

According to an exemplary embodiment of the present invention, since the maximum sheet stacking amount in two-sided mode is smaller than the maximum sheet stacking amount in one-sided mode, productivity or image quality is not adversely affected and blocking of sheets can be prevented.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
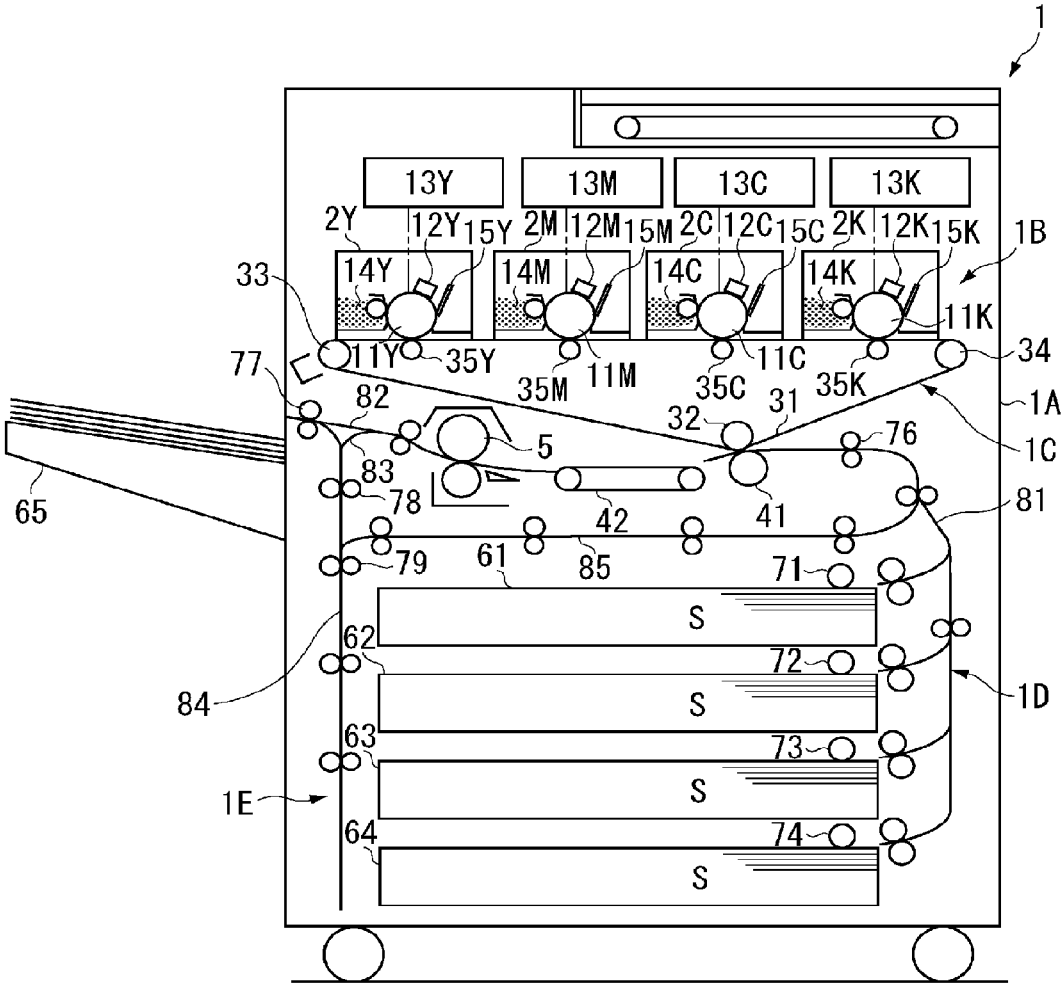
FIG. 1 illustrates a schematic configuration for a color laser printer which is an example of an image forming apparatus according to a first exemplary embodiment of the present invention.

FIG. 1 illustrates the schematic configuration of a color laser printer which is an example of an image forming apparatus according to a first exemplary embodiment of the present invention. FIG. 1 illustrates a color laser printer 1 and a color laser printer main body 1A (hereafter printer main body). The printer main body 1A includes an image forming portion 1B that forms an image on a sheet S, an intermediate transfer portion 1C, a fixing device 5, and a sheet feed device 1D that feeds the sheet S to the image forming portion 1B. The color laser printer 1 is adapted to form an image on a back surface of the sheet S and, for that purpose, includes a reconveyance unit 1E that reverses the sheet S having an image formed on the front surface (one side) thereof and conveys the sheet again to the image forming portion 1B.

The image forming portion 1B includes four process stations 2 (2Y, 2M, 2C, and 2K) forming a four-colored toner image from yellow (Y), magenta (M), cyan (C), and black (Bk). The process station 2 includes a photosensitive drum 11 (11Y, 11M, 11C, and 11K) which is an image bearing member that is driven by a stepping motor (not illustrated) and which supports a four-colored toner image respectively formed from yellow, magenta, cyan, and black. A charging device 12 (12Y, 12M, 12C, and 12K) generates a uniform charge on the surface of the photosensitive drum 11. An exposure device 13 (13Y, 13M, 13C, and 13K) forms an electrostatic latent image on the photosensitive drum 11 that is illuminated by a laser beam based on image information, and rotates at a fixed speed. A development device 14 (14Y, 14M, 14C, and 14K) fixes yellow, magenta, cyan and black toner in an electrostatic latent image formed on the photosensitive drum 11 to thereby make the toner image visible. The charging device 12, the exposure device 13, the development device 14, and the like are disposed respectively along a rotation direction on the periphery of the photosensitive drum 11.

The sheet feed device 1D is provided on a lower portion of the printer main body 1A and includes a paper feed cassette (61-64) which is a sheet storage portion for storing sheets S, and a pick-up roller (71-74) that transfers a sheet S stacked and stored in the paper feed cassette (61-64). When an image forming operation is started, respective sheets S are separated and fed from the paper feed cassette (61-64) by the pick-up roller (71-74). Thereafter, the sheet S passes through a vertical conveyance path 81, and is conveyed to a registration roller 76. The registration roller 76 has a function of following a distal end of the sheet S to thereby correct skew since a sheet when protruding forms a loop. The registration roller 76 also has a function of conveying the sheet S to a secondary transfer portion at a predetermined timing coinciding with the toner image supported on an intermediate transfer belt, that is to say, the timing of image formation on the sheet S. When a sheet S is conveyed, the registration roller 76 is stopped and the sheet S protrudes and makes contact with the registration roller 76 in such a stationary state and thereby forms a warp on the sheet S. Thereafter, stiffness in the sheet S causes the sheet distal end to come into contact with the nip of the registration roller 76 and thereby corrects skew in the sheet S. Then, the registration roller 76 with the sheet S with corrected skew thereon is driven at a timing which coordinates the distal end of the sheet S with the toner image formed on the intermediate transfer belt 31 as described below.

The intermediate transfer portion 1C includes the intermediate transfer belt 31, which is synchronized with the outer peripheral speed of the photosensitive drum 11 and rotated in the aligned direction of each process station 2 as shown by the arrow. The intermediate transfer belt 31 is suspended on a drive roller 33, a driven roller 32 that sandwiches the intermediate transfer belt 31 and forms a secondary transfer area, and a tension roller 34 that applies a suitable tension to the intermediate transfer belt 31 with a biasing force of a spring (not illustrated). The inner side of the intermediate transfer belt 31 is disposed on four primary transfer rollers 35 (35Y, 35M, 35C, and 35K) respectively sandwiching the intermediate transfer belt 31 and the photosensitive drum 11 to thereby configure a primary transfer portion. These primary transfer rollers 35 are connected to the transfer bias power source (not illustrated). The application of a transfer bias to the intermediate transfer belt 31 from the primary transfer roller 35 enables multiple transfer of each color of the toner image on the photosensitive drum 11 to the intermediate transfer belt 31 and forms a full-color image on the intermediate transfer belt 31.

A secondary transfer roller 41 is disposed to face the driven roller 32, and abuts with the lowermost surface of the intermediate transfer belt 31. A sheet S conveyed by the registration roller 76 is sandwiched and conveyed together with the intermediate transfer belt 31. When the sheet S passes the nip portion of the intermediate transfer belt 31 and the secondary transfer roller 41, the application of a bias to the secondary transfer roller 41 enables secondary transfer of the toner image on the intermediate transfer belt 31 to the sheet S. The fixing device 5 configuring a fixing unit fixes the toner image formed on the sheet through the intermediate transfer belt 31 onto the sheet S. The sheet S supporting the toner image fixes the toner image by application of heat and pressure when the sheet S passes through the fixing device 5.

Next, the image forming operation of the color laser printer 1 configured as described above will be described. When the image forming operation is started, the process station 2Y, which is most upstream relative to the rotation direction of the intermediate transfer belt 31, executes laser illumination with the exposure apparatus 13Y of the photosensitive drum 11Y to thereby form a yellow latent image on the photosensitive drum 11Y. Then, the development apparatus 14Y forms a yellow toner image by developing the latent image with yellow toner. Then, the yellow toner image formed on the photosensitive drum 11Y undergoes primary transfer onto the intermediate transfer belt 31 in the primary transfer area by a transfer roller 35Y, which is subjected to a high voltage.

Next, the toner image is conveyed to the primary transfer area configured by the photosensitive drum 11M and the transfer roller 35M of the next process station 2M forming the image by delaying for the time for conveying the toner image from the process station 2Y together with the intermediate transfer belt 31. The subsequent magenta toner image is transferred with the distal end of the image coordinated with the yellow toner image on the intermediate transfer belt. Thereafter, the same process is repeated and, as a result, a four-color toner image is subjected to primary transfer onto the intermediate transfer belt 31 to thereby form a full-color image on the intermediate transfer belt 31. The slight amount of residual toner after transfer, which remains on the photosensitive drum, is recovered by the photosensitive cleaner 15 (15Y, 15M, 15C, and 15K) and is re-used in subsequent image formation.

In parallel with the toner image formation operation, respective sheets S which are stored in the paper feeding cassette (61-64) are separated and fed by the pick-up roller (71-74) and then are conveyed to the registration roller 76. At this time, the registration roller 76 is stopped and skew in the sheet S is corrected with the sheet S protruding to come into contact with the stopped registration roller 76. After correction of skew, the sheet S is conveyed to a nip portion of the secondary transfer roller 41 and the intermediate transfer belt 31 by the registration roller 76, which starts to rotate at a timing at which the sheet distal end coincides with the toner image formed on the intermediate transfer belt 31. When the sheet is sandwiched and conveyed by the secondary transfer roller 41 and the intermediate transfer belt 31 and passes through the nip portion of the secondary transfer roller 41 and the intermediate transfer belt 31, the toner image on the intermediate transfer belt 31 is subjected to secondary transfer by a bias applied to the secondary transfer roller 41.

Next, the sheet S including the toner image from secondary transfer is conveyed to the fixing device 5 by a pre-fixing conveyance device 42. The fixing device 5 fuses and affixes the toner image onto the sheet S by application of predetermined pressure from opposed rollers, a belt or the like, and generally a heating effect from a heat source such as a heater or the like. The color laser printer 1 includes a one-sided mode in which an image is formed on one surface of the sheet S and a two-sided mode in which images are formed on both the front and back sides of at least one of the sheets. When in one-sided mode, the sheet S with a fixed image is selectively conveyed by a switching member (not shown) to a discharge conveying path 82, and when in two-sided mode, the sheet S which has a fixed image is selectively conveyed to a reverse guidance path 83.

When in one-sided mode, the sheet S with a fixed image passes through the discharge conveying path 82 which is a discharge path and is discharged into a discharge tray 65 which is a sheet stacking portion by the discharge roller 77 which is a discharge member. When in two-sided mode, the sheet S passes through the reverse guidance path 83 and is drawn into the switchback path 84 by the first reverse roller pair 78 and the second reverse roller pair 79. Thereafter, the sheet S is conveyed by the switchback path 84 by the forward and reverse reciprocal rotation of the second reverse roller pair 79 to the two-sided conveying path 85 in a state in which the distal end is reversed. Then, the sheet S is re-merged with the flow and coordinated with the timing of the sheet S of the next job which is conveyed by the pickup roller (71-74), and in the same manner, is conveyed to the secondary transfer portion through the registration roller 76. The subsequent image forming process for the back surface (second surface) is similar to that for the front surface (first surface) described above.

Figure 2:
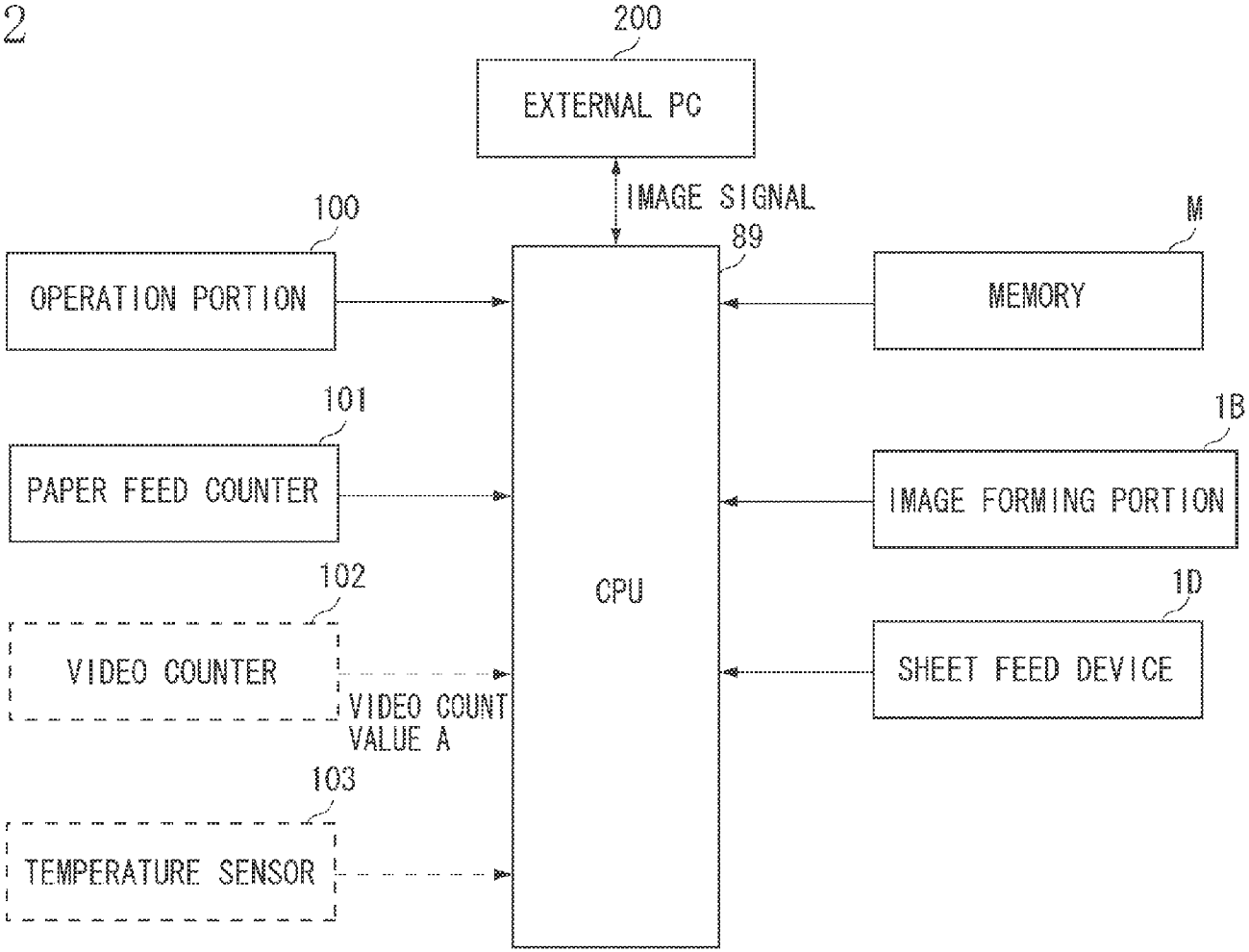
FIG. 2 is a block diagram illustrating control of the color laser printer according to the first exemplary embodiment of the present invention.

FIG. 2 is a block diagram illustrating control of the color laser printer 1 enabling selective discharge of a sheet having an image formed on one surface thereof and a sheet having an image formed on both surfaces thereof with toner. A central processing unit (CPU) 89 provided as a control portion in a predetermined position in the printer main body 1A connects to an operation portion 100 disposed on an upper surface of the printer main body 1A for example and a paper feed counter 101 which counts the number of fed sheets (number of image forming sheets). An external PC 200 configured to output an image signal is connected with a memory M configured to store a stacking amount limiting value when in one-sided mode and two-sided mode. When the number of stacked sheets increases as described above, a blocking phenomenon causing blocking of sheets occurs due to the weight of sheets discharged and stacked in the discharge tray. Even for the same number of sheets, when the weight per sheet increases and the number of stacked sheet increases due to formation of a toner image on both sheet surfaces, there is a tendency for the blocking phenomenon to occur. Furthermore when in two-sided mode, since the toner on sheets stacked in the discharge tray comes into direct contact, there is a tendency for the blocking phenomenon to occur. Thus, in the present exemplary embodiment, the occurrence of the blocking phenomenon is prevented since the CPU 89 is configured to limit the maximum sheet stacking amount in the discharge tray 65 according to the mode set by the operation portion 100, which is a mode setting portion. In the present exemplary embodiment, the maximum sheet stacking amount in the discharge tray 65 when one-sided mode is set by the operation portion 100, that is to say, the stacking amount limiting value $\alpha$, is 250 sheets, and when in two-sided mode, the stacking amount limiting value $\alpha$ in the discharge tray 65 is set to 150 sheets.

Figure 3:
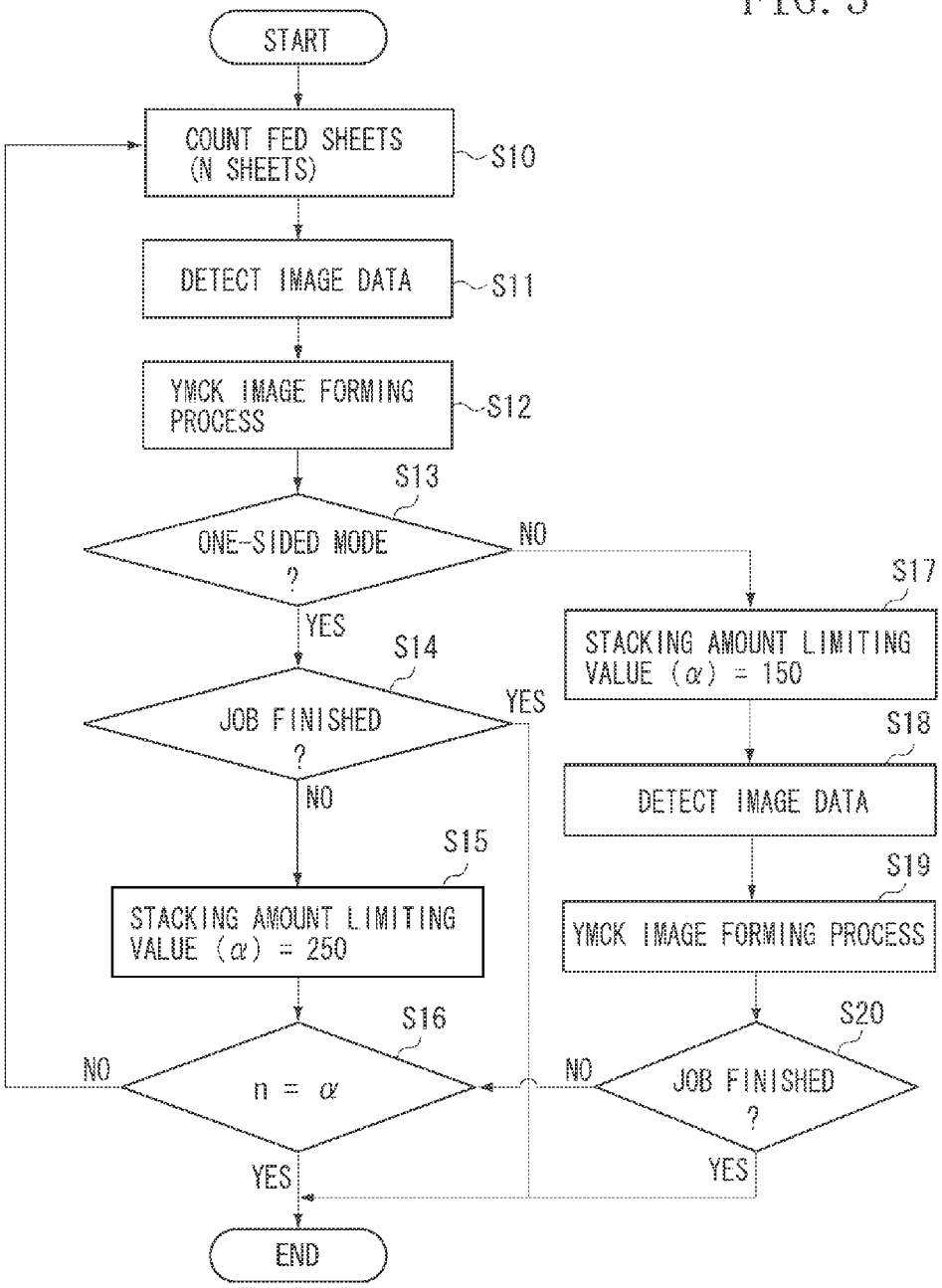
FIG. 3 is a flowchart illustrating stacking limiting control for the color laser printer according to the first exemplary embodiment of the present invention.

Next, the stacking limiting control according to the mode in the present exemplary embodiment will be described with reference to a flowchart illustrated in FIG. 3. Firstly, in step S10, the CPU 89 starts feeding of sheets and counts the sheet feed number which is the sheet number information with a sheet feed counter which is a stacking number detection portion configured to detect the number of discharged sheets. Then in step S11, the CPU 90 detects the image data, and in step S12, the CPU 89 executes an image formation process for Y, M, C, and K as described above and thereby forms an image on one surface of the sheet. Then in step S13, the CPU 89 determines whether the set mode is the one-sided mode or the two-sided mode. When the mode is one-sided mode (YES in step S13), then in step S14, the CPU 89 determines whether the job is finished. When the job is not finished (NO in step S14), then in step S15, the CPU 89 reads the stacking amount limiting value $\alpha$ (250 sheets) for one-sided mode from the memory M. Then in step S16, the CPU 89 compares the stacking amount limiting value $\alpha$ and the sheet feed number counted by the sheet feed counter. When the result of the comparison shows that the counted sheet feed number n has not reached 250 sheets, which is the stacking amount limiting value $\alpha$ (NO in step S16), the CPU 89 repeats steps S10 to S15, and when the counted sheet feed number n has reached 250 sheets (YES in step S16), the CPU 89 stops the image formation operation even if the job completion has not finished.

When not in one-sided mode (NO in step S13), that is to say, when in two-sided mode, then in step S17, the CPU 89 reads the stacking amount limiting value $\alpha$ (150 sheets) for two-sided mode from the memory M. Then in step S18, the CPU 89 detects the image data for the image formed on the back surface (second surface) of the sheet, and in step S19, the CPU 89 executes an image forming process for Y, M, C, and K as described above on the back surface of the sheet. Next, in step S20, the CPU 89 determines whether the job is finished. When the job is not finished (NO in step S20), then in step S16, the CPU 89 compares the stacking amount limiting value $\alpha$ and the sheet feed number counted by the sheet feed counter. When the result of the comparison shows that the counted sheet feed number n has not reached 150 sheets, which is the stacking amount limiting value $\alpha$ (NO in step S16), the CPU 89 repeats steps S10 to S13 and steps S17 to S19, and when the counted sheet feed number n has reached 150 sheets (YES in step S16), the CPU 89 stops the image formation operation even if the job has not finished.

Thus, sheet blocking can be prevented by reducing the stacking amount limiting value $\alpha$ for two-sided mode to less than the stacking amount limiting value α for the discharge tray 65 when in single-side mode without increasing the sheet-to-sheet distance or reducing the fixing temperature. In other words, in the present exemplary embodiment, since the stacking amount limiting value for two-sided mode is made smaller than the stacking amount limiting value for one-sided mode, sheet blocking can be prevented without increasing the sheet-to-sheet distance or reducing the fixing temperature.

However in the description above, although the blocking phenomenon is prevented by limiting the stacking amount in the discharge tray 65 according to the mode, the present invention is not limited in that respect. For example, even when in one-sided mode, sheet weight increases as the toner amount forming the image on the sheet increases, and therefore the sheets tend to block. Thus, the maximum sheet stacking amount in the discharge tray 65 may be limited according to the amount of toner used to form an image formed on a sheet.

Figure 4:
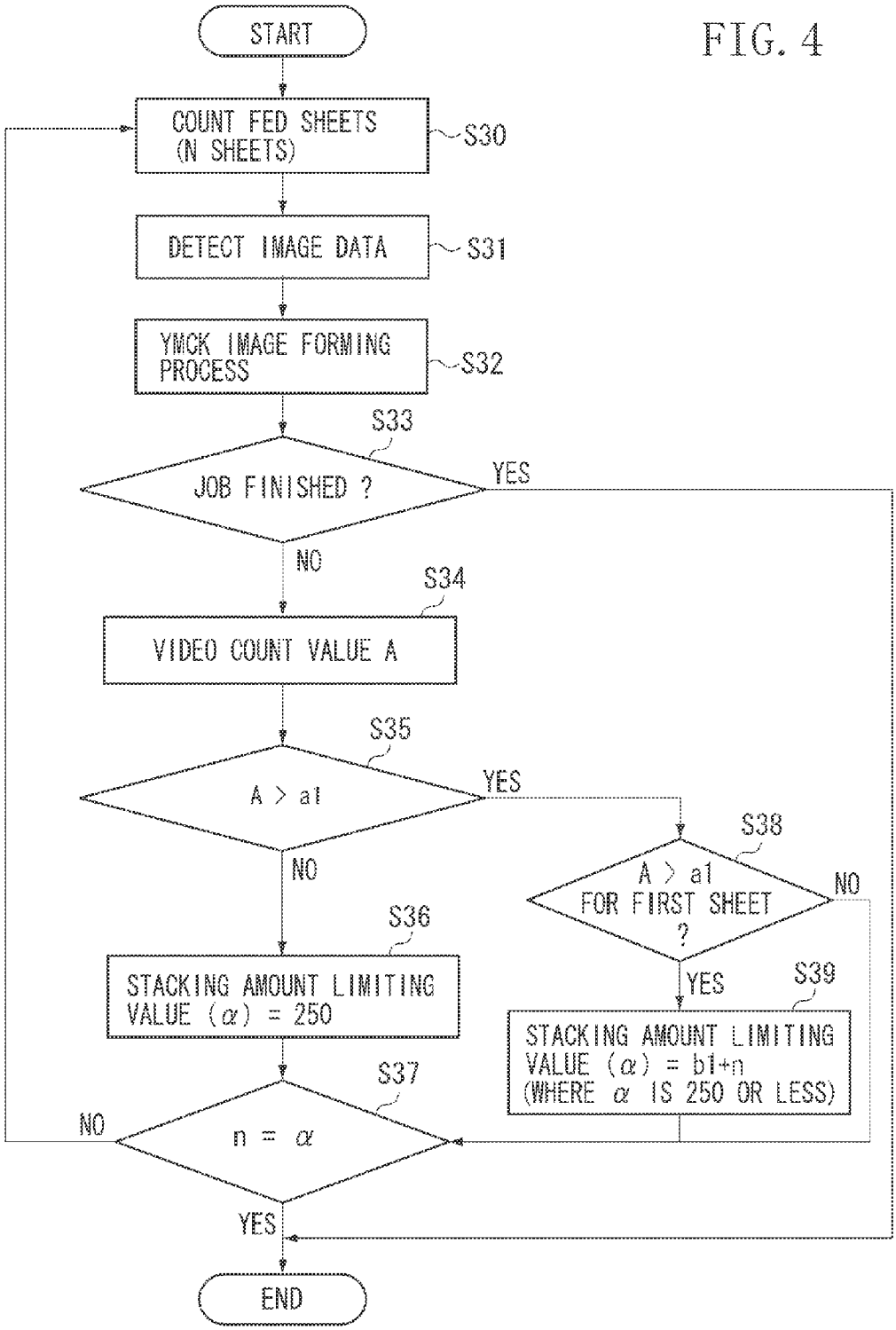
FIG. 4 is a flowchart illustrating stacking limiting control for an image forming apparatus according to a second exemplary embodiment of the present invention.

Next, a second exemplary embodiment of the present invention will be described in which the maximum sheet stacking amount in the discharge tray 65 is limited according to the toner amount used to form an image on a sheet. FIG. 4 is a flowchart illustrating stacking limiting control according to the toner amount on the sheet according to the second exemplary embodiment of the present invention.

The toner amount is determined by a video count value A. The video count value A is the total of data portions expressed by the portion of data (1) which is used to develop image data with toner from, for example, an external PC 200 and the portion of data (0) which is not used to develop it. In the present exemplary embodiment, a video counter 102, which counts the number of dots fixed with toner of the image data, is connected to the CPU 89, as illustrated in FIG. 2 above. The CPU 89 is configured to acquire a toner amount for an image formed by the video count value, which is toner amount information from the video counter 102, which is a toner amount detection portion.

In the present exemplary embodiment, the maximum stacking amount when stacking sheets S in the discharge tray 65 is 250 sheets. In this case, during a single continuous sheet-passing job, when the video count value A for all sheets is less than or equal to a predetermined reference value a1, the overall stacking amount limiting value α is 250 sheets. On the other hand, when the video count value A for the n-th fed sheet exceeds the reference value a1 for the first time during a single continuous sheet-passing job, the stacking amount limiting value α is set as (b1+n) (where a is an integer less than or equal to 250, b1 is an integer greater than 0 and less than 250). The residual stacking sheet number b1 is a value which sets how many sheets are stacked on the sheet S for which the video count value A exceeds the reference value a1, and may be set arbitrarily according to the state of the blocking phenomenon.

For example, when the video count value A for the 10th sheet (n=10) exceeds the reference value a1 for the first time during a single continuous sheet-passing job, if the residual stacking sheet number b1 takes a value of 100, the stacking amount limiting value α is set to 110 sheets. The value of the residual stacking sheet number b1 becomes smaller as the sheet number n when the video count value A during a single continuous sheet-passing job exceeds the reference value a1 for the first time becomes larger. In other words, as the sheet stacking number after the first sheet exceeding the toner amount decreases, the sheet stacking amount in the discharge tray 65 after the sheet exceeding the toner amount takes smaller values. The occurrence of a blocking phenomenon in which the sheet exceeding the toner amount is blocked by the weight of sheets stacked on top of the sheet exceeding the toner amount can be prevented by reducing the stacking amount of sheets on top of the sheet that exceeds the reference value a1. For example, when the video count value A for the 200th sheet (n=200) exceeds the reference value a1 for the first time during a single job, thereafter, when a blocking phenomenon does not occur even when sheets are stacked on top of that sheet, the stacking amount limiting value α takes a value of 250 sheets. During a single continuous sheet-passing job, when the video count value A has exceeded the reference value a1, thereafter, even when the video count value A exceeds the reference value a1 during the same job, the stacking amount limiting value α is not changed. In the present exemplary embodiment, a table indicating the relationship of the sheet number n and the residual stacking sheet number b1 when the reference value a1 is exceeded for the first time, the reference value a1, and the stacking amount limiting value α are stored in the memory M illustrated in FIG. 2 as described above. When executing stacking limiting control according to the embodiment as described below, the CPU 89 reads the stacking amount limiting value α, the reference value a1, and the residual sheet number b1 from the memory M.

When executing stacking limiting control, firstly in step S30, the CPU 89 starts sheet feeding and counts the sheet feed number with the sheet feed counter. Then in step S31, the CPU 89 detects the image data and in step S32, the CPU 89 executes an image forming process for Y, M, C, and K as described above. Next, in step S33, the CPU 89 determines whether the job is finished. When the job is not finished (NO in step S33), then in step S34, the CPU 89 reads the video count value A of the video counter 102. Then in step S35, the CPU 89 compares the video count value A and the preset reference value a1. When the result of the comparison shows that the video count value A has not exceeded the reference value a1 (NO in step S35), then in step S36, the CPU 89 reads the stacking amount limiting value α (250 sheets) from the memory M. Thereafter, in step S37, the CPU 89 compares the stacking amount limiting value α with the sheet feed number n counted by the sheet feed counter. When the result of the comparison shows that the sheet feed number n counted by the sheet feed counter has not reached 250, which is the stacking amount limiting value α (NO in step S37), the CPU 89 repeats steps S30 to S36. When the sheet feed number n has reached 250 (YES in step S37), the CPU 89 stops the image formation operation even if the job has not finished. Alternatively, even when the sheet feed number has not reached 250 (NO in step S37), if the job is finished (YES in step S33), the CPU 89 stops the image formation operation.

On the other hand, when the video count value A has exceeded the reference value a1 (YES in step S35), then in step S38, the CPU 89 determines whether the n-th sheet which is the sheet exceeding the toner amount at which the video count value A exceeds the reference value a1 is the first sheet to exceed the reference value a1. When that sheet is the first sheet (YES in step S38), then in step S39, the CPU 89 reads the residual stacking sheet number b1 for the n-th sheet from the table stored in the memory M and uses (b1+n) to calculate the stacking amount limiting value α. Then, in step S37, the CPU 89 compares the calculated stacking amount limiting value α and the sheet feed number n counted by the sheet feed counter. When the comparison shows that the counted sheet feed number n has not reached the calculated stacking amount limiting value α (NO in step S37), the CPU 89 repeats steps S30 to S35 and S38. When the counted sheet feed number n has reached the calculated stacking amount limiting value α (YES in step S37), the CPU 89 stops the image formation operation even if the job has not finished.

In the present exemplary embodiment, when the video count value A for the n-th sheet exceeds the reference value a1 at which a blocking phenomenon occurs, the stacking amount for sheets stacked after that sheet is placed to a value less than when there is no sheet exceeding the toner amount. In this manner, blocking of sheets can be prevented. In other words, the toner amount forming images is calculated by counting image data developed by toner, and when there is a sheet having an image formed by toner that is greater than or equal to a predetermined amount, blocking of sheets can be prevented by reducing the maximum sheet stacking amount. Furthermore, when the toner amount is relatively small, since a sheet stacking limit is implemented according to the toner amount on the sheet, there is no need to reduce the stacking amount more than required.

In the present exemplary embodiment, although there is no limitation on the paper-passing mode (one-sided mode, two-sided mode), since an image is formed on both surfaces of the sheet by toner, the paper-passing mode may be limited to only two-sided mode in which the video count value A exceeds the reference value a1. When the video count value A exceeds the reference value a1 during a single job, as described above, an image forming operation may stop for a predetermined time even when the job has not been finished. After the passage of a predetermined time, the image forming operation may be started again and sheet stacking started again. The predetermined time, that is to say, the timing at which the job is restarted, is varied according to the size of the video count value A from the video counter 102, which functions as a toner amount detection portion. In other words, it is varied according to the toner amount on the sheet exceeding the toner amount. For example, when the video count value A is large, if the restart is brought forward, sheet blocking will tend to occur. Thus, the time until restarting a job is delayed. Furthermore, a sheet presence/absence detection sensor (not illustrated) is provided to detect the presence or absence of a sheet on the discharge tray. When the sheet presence/absence detection sensor detects that a sheet is not present in the discharge tray, the time until job restarts may be reduced.

The description above has discussed comparing the video count value for each stacked sheet and limiting the sheet stacking amount stacked after the sheet at which the toner amount forming images for a single continuous paper-passing job exceeds a predetermined toner amount. However, the invention is not limited in this respect and the stacking amount limiting value $\alpha$ may be varied each time it is determined that the video count value A during the same job has exceeded the reference value a1. When it is determined that there is a sheet at which the toner amount forming images for a single continuous paper-passing job exceeds a predetermined toner amount, the stacking amount for all sheets in that job may be limited.

Although the description above has discussed limiting the stacking amount in the discharge tray 65 according to a toner amount to effectively prevent occurrence of a blocking phenomenon, the present invention is not limited in that respect. For example, the stacking of sheets in the discharge tray 65 may be stopped according to a surface temperature of a sheet discharged onto the discharge tray.

Figure 5:
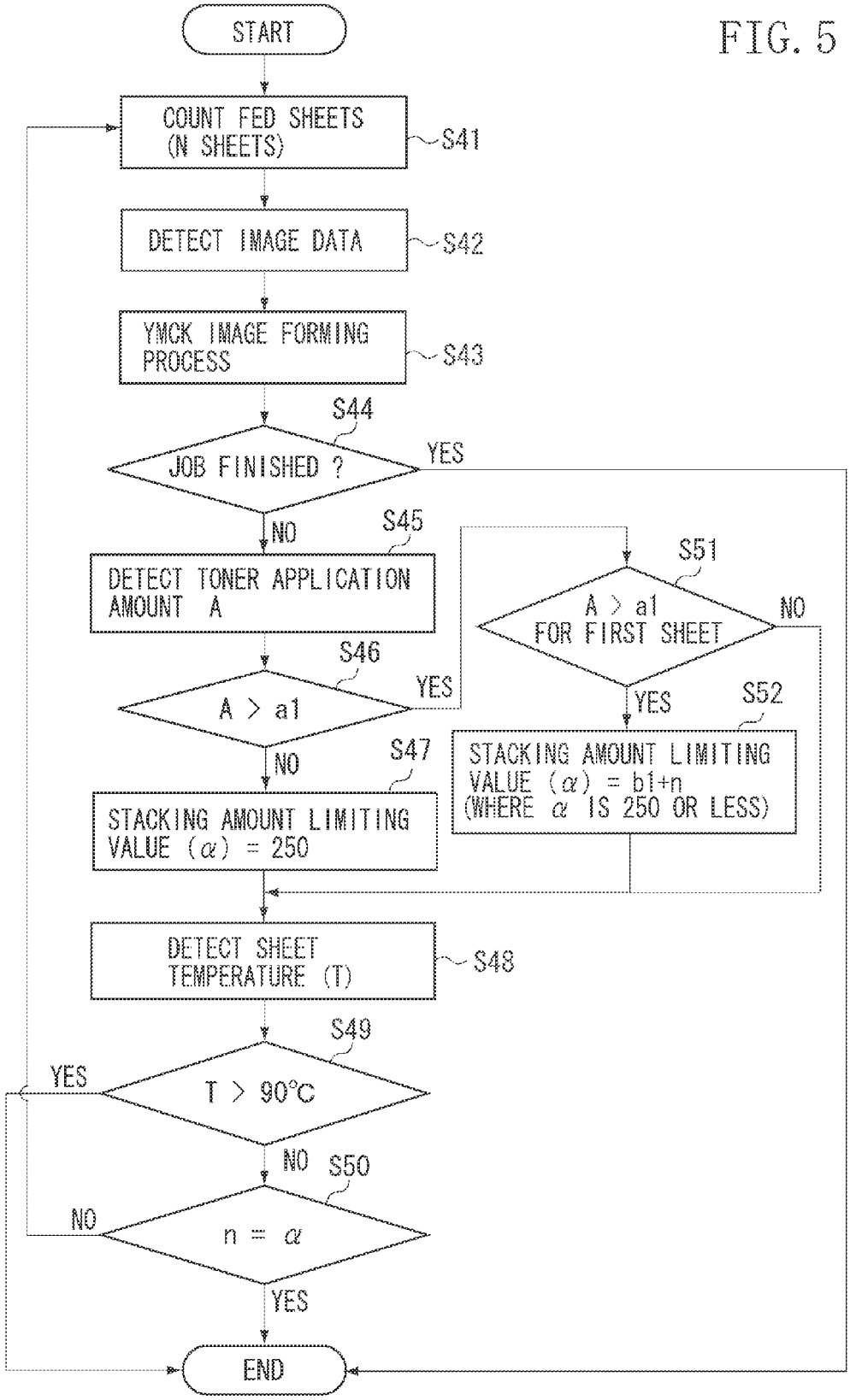
FIG. 5 is a flowchart illustrating stacking limiting control for an image forming apparatus according to a third exemplary embodiment of the present invention.

Next, a third exemplary embodiment of the present invention will be described in which stacking of sheets in the discharge tray 65 is stopped according to a surface temperature of a sheet discharged into the discharge tray. FIG. 5 is a flowchart illustrating stacking limiting control for an image forming apparatus according to the third exemplary embodiment. In the present exemplary embodiment, a temperature detection sensor 103, which is a temperature detection portion configured to detect a surface temperature of a sheet S discharged onto a discharge tray 65, is connected to the CPU 89, as illustrated in FIG. 2. The temperature detection sensor 103 is disposed in proximity to the discharge tray 65 and may be either a contact type or non-contact type. The CPU 89 limits (stops) the stacking amount stacked onto the discharge tray 65 based on the temperature information of the temperature detection sensor 103. For example, during a single continuous paper-passing job, when the surface temperature of a sheet S discharged onto the discharge tray 65 exceeds 90° C., which is a predetermined temperature, the job is stopped. When the surface temperature of a discharged sheet S exceeds 90° C. during a single continuous paper-passing job, that is to say, if the surface temperature of a discharged sheet S exceeds a predetermined temperature, the minimum time until starting of the next job can be limited (increased).

In the present exemplary embodiment, when executing stacking limiting control, firstly in step S41, the CPU 89 starts to feed sheets and counts the sheet feed number with the sheet feed counter. In step S42, the CPU 89 detects the image data, and then in step S43, the CPU 89 executes an image formation process for Y, M, C, and K as described above and thereby forms an image on the sheet. Then in step S44, the CPU 89 determines whether the job is finished. When the job is not finished (NO in step S44), then in step S45, the CPU 89 detects the video count value A (toner application amount A) of the video counter 102. Then in step S46, the CPU 89 compares the video count value A (toner application amount A) and the preset reference value a1. When the result of the comparison shows that the video count value A has not exceeded the reference value a1 (NO in step S46), then in step S47, the CPU 89 reads the stacking amount limiting value $\alpha$ (250 sheets).

Then in step S48, the CPU 89 detects a sheet temperature (T) from the temperature detection sensor 103 of a sheet discharged into the discharge tray 65 and, then in step S49, it detects whether the sheet temperature (T) exceeds 90° C. When the sheet temperature (T) does not exceed 90° C. (NO in step S49), then in step S50, the CPU 89 compares the stacking amount limiting value $\alpha$ and the sheet feed number n counted by the sheet feed counter. When the result of the comparison shows that the counted sheet feed number n has not reached 250 sheets (NO in step S50), the CPU 89 repeats steps S41 to S49, and when the counted sheet feed number n has reached 250 sheets (YES in step S50), the CPU 89 stops the image formation operation even if the job has not finished. Even when the sheet feed number n has not reached 250 sheets (NO in step S50), when the job has finished (YES in S44), the CPU 89 immediately stops the image forming operation.

On the other hand, when the video count value A (toner application amount A) has exceeded the reference value a1 (YES in step S46), then in step S51, the CPU 89 determines whether the n-th sheet at which the video count value A (toner application amount A) exceeds the reference value a1 is the first sheet to exceed the reference value a1. When it is the first sheet (YES in step S51), then in step 52, the CPU 89 reads the residual stacking sheet number b1 for the n-th sheet from the table stored in the memory M and uses (b1+n) to calculate the stacking amount limiting value $\alpha$. Then, in step S48, the CPU 89 detects a sheet temperature (T) from the temperature detection sensor 103 of a sheet discharged into the discharge tray 65 and, then in step S49, it detects whether the sheet temperature (T) exceeds 90° C. When the sheet temperature (T) does not exceed 90° C. (NO in step S49), then in step S50, the CPU 89 compares the stacking amount limiting value $\alpha$ and the sheet feed number n counted by the sheet feed counter.

When the result of the comparison shows that the counted sheet feed number n has not reached 250 sheets (NO in step S50), the CPU 89 repeats step S41 to S46, S51, S52, S48, and S49. When the counted sheet feed number n has reached 250 sheets (YES in step S50), the CPU 89 stops the image formation operation even if the job has not finished. On the other hand, when the sheet temperature (T) exceeds 90° C. (YES in step S49), the CPU 89 stops the image formation operation even if the job has not finished.

In this manner, in the present exemplary embodiment, when a sheet temperature (T) exceeds 90° C. at which a blocking phenomenon occurs, the image forming operation is stopped. When the temperature (T) does not exceed 90° C., a blocking phenomenon can be effectively prevented by placing a maximum limit on the stacking amount in the discharge tray 65. When the temperature (T) exceeds 90° C., or when the image forming operation has stopped even when the job completion has not finished, although the job is started again, the timing of the job startup is delayed according to the increase of the sheet temperature (T). In other words, when the sheet temperature (T) is high, if the restart is brought forward, sheet blocking will tend to occur. Therefore, the time until the job restarts is increased. Furthermore, a sheet presence/absence detection sensor (not illustrated) is provided to detect the presence or absence of a sheet on the discharge tray. When the sheet presence/absence detection sensor confirms that a sheet is not present in the discharge tray, the time until the job restarts may be shortened.

The present exemplary embodiment displays the effects above when applied in the first and second exemplary embodiments. Even when the first and second exemplary embodiments are adapted to suppress the occurrence of sheet blocking, the surface temperature of the sheet discharged onto the discharge tray may increase due to effects including an external temperature. A blocking phenomenon can be more accurately prevented by incorporating the present exemplary embodiment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

What is claimed is:

1. An image forming apparatus having a one-sided image forming mode in which a toner image is formed on one surface of a sheet and a two-sided image forming mode in which toner images are formed on both surfaces of at least one of the sheets, the image forming apparatus comprising:

a transfer portion configured to transfer a toner image on a sheet;

a fixing unit configured to fix the transferred toner image on the sheet by heat;

a sheet stacking portion configured to stack sheets having the toner images fixed thereon;

a sheet discharging portion configured to discharge the sheet, having the toner image fixed by the fixing unit, to the sheet stacking portion; and a control portion configured to set a limiting value of a sheet stacking amount in the sheet stacking portion according to an image forming mode selected between the one-sided image forming mode and the two-sided image forming mode, wherein the limiting value of the sheet stacking amount in each image forming mode is determined so that blocking of sheets, occurring due to a weight of sheets discharged and stacked in the sheet stacking portion, can be prevented, and the limiting value of the sheet stacking amount in the two-sided image forming mode is smaller than that in the one-sided image forming mode.

2. The image forming apparatus according to claim 1, wherein, if a job has not been finished due to limiting the sheet stacking amount of the sheets, the control portion stops stacking of sheets for a predetermined time and then restarts stacking of sheets after stacking sheets corresponding to the sheet stacking amount.

3. The image forming apparatus according to claim 2, further comprising a toner amount detection portion configured to detect an amount of toner used for image formation on each sheet, wherein the control portion varies the predetermined time according to toner amount information from the toner amount detection portion.

4. The image forming apparatus according to claim 1, further comprising a temperature detection portion configured to detect a temperature of a sheet stacked in the sheet stacking portion, wherein the control portion stops stacking of sheets when the temperature of a sheet stacked in the sheet stacking portion becomes greater than or equal to a predetermined temperature based on temperature information from the temperature detection portion.

5. The image forming apparatus according to claim 4, wherein the control portion increases a time from stopping stacking of sheets to restarting stacking of sheets according to the temperature of a sheet stacked in the sheet stacking portion.

* * * * *